US010283909B2

(12) United States Patent
Holub

(10) Patent No.: US 10,283,909 B2
(45) Date of Patent: May 7, 2019

(54) METHOD OF OPERATING A CONNECTOR LATCH

(71) Applicant: J.S.T. CORPORATION, Farminton Hills, MI (US)

(72) Inventor: Franklin A. Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/384,755

(22) Filed: Dec. 20, 2016

(65) Prior Publication Data

US 2017/0179643 A1 Jun. 22, 2017

Related U.S. Application Data

(60) Provisional application No. 62/270,219, filed on Dec. 21, 2015.

(51) Int. Cl.
*H01R 13/627* (2006.01)
*H01R 13/641* (2006.01)

(52) U.S. Cl.
CPC ..... *H01R 13/641* (2013.01); *H01R 13/6272* (2013.01); *H01R 13/6273* (2013.01)

(58) Field of Classification Search
CPC ..... H01R 13/6275; H01R 24/62
USPC ..... 439/354, 344, 358
See application file for complete search history.

(56) References Cited

U.S. PATENT DOCUMENTS 5,330,369 A 7/1994 Nozaki et al.
5,584,719 A * 12/1996 Tsuji ..... H01R 13/6272 439/354
5,628,649 A * 5/1997 Yagi ..... H01R 13/6272 439/354
5,759,058 A 6/1998 Childs et al.
(Continued)

FOREIGN PATENT DOCUMENTS

EP 0862244 A1 9/1998
EP 1096616 A2 5/2001
(Continued)

OTHER PUBLICATIONS

European Search Report for counterpart EPC Patent Application No. 17191762.8 dated Dec. 4, 2017 (8 Sheets).
(Continued)

*Primary Examiner* — Phuong K Dinh
(74) *Attorney, Agent, or Firm* — Kratz, Quintos & Hanson, LLP

(57) ABSTRACT

Connector latch used to securely hold together a connector apparatus, such that the connector apparatus has at least a first connector assembly and a second connector assembly which can be mated together. Initially, after the connector latch is manufactured, the connector latch is in an undeflected position. After manufacture, the connector latch is subjected to a pre-mating deflection process, in order to move the connector latch into a preloaded position. After the pre-mating deflection process has been completed, the connector latch is locked in the preloaded position. The preloaded connector latch provides a number of desirable characteristics, including at least an extra loud "click" sound when the first connector assembly and the second connector assembly are mated together.

24 Claims, 16 Drawing Sheets

(56) References Cited

U.S. PATENT DOCUMENTS

| | | | | |
|---|---|---|---|---|
| 5,823,813 | A | 10/1998 | Dye | |
| 6,116,939 | A * | 9/2000 | Fukuda | H01R 13/6272 439/354 |
| 6,186,819 | B1 | 2/2001 | Holub | |
| 6,312,277 | B1 | 11/2001 | Holub | |
| 6,435,895 | B1 | 8/2002 | Fink et al. | |
| 7,909,638 | B2 | 3/2011 | Seo et al. | |
| 8,747,146 | B2 | 6/2014 | Brown et al. | |
| 8,920,187 | B2 | 12/2014 | Kon et al. | |
| 2002/0045380 | A1 | 4/2002 | Endo et al. | |
| 2003/0171027 | A1 | 9/2003 | Shuey et al. | |
| 2004/0067676 | A1 | 4/2004 | Nimura | |
| 2004/0248453 | A1* | 12/2004 | McLauchlan | H01R 13/6272 439/352 |
| 2012/0282791 | A1 | 11/2012 | Brown et al. | |
| 2014/0206220 | A1 | 7/2014 | George | |
| 2016/0164224 | A1* | 6/2016 | Sekino | H01R 13/6272 439/352 |
| 2017/0062982 | A1 | 3/2017 | Holub et al. | |
| 2017/0062983 | A1 | 3/2017 | Holub et al. | |
| 2017/0179643 | A1 | 6/2017 | Holub | |
| 2017/0179646 | A1* | 6/2017 | Holub | H01R 13/641 |

FOREIGN PATENT DOCUMENTS

| | | | |
|---|---|---|---|
| EP | 1926183 | A2 | 5/2008 |
| JP | 07-335322 | A | 12/1995 |
| JP | 2016-115570 | A | 6/2016 |

OTHER PUBLICATIONS

Extended European Search Report in European Application No. 17191762.8, dated Dec. 12, 2017.
Extended European Search Report in counterpart European Application No. 17191751.1, dated Mar. 27, 2018.
USPTO Office Action in U.S. Appl. No. 15/384,743, dated Jul. 27, 2017.
USPTO Office Action in U.S. Appl. No. 15/384,743, dated Feb. 16, 2018.
U.S. Appl. No. 15/854,287, filed Dec. 26, 2017.
U.S. Appl. No. 15/854,295, filed Dec. 26, 2017.
USPTO Office Action in U.S. Appl. No. 15/243,008, dated May 3, 2018.
USPTO Office Action in U.S. Appl. No. 15/243,023, dated Oct. 27, 2017.
USPTO Office Action in U.S. Appl. No. 15/243,023, dated Apr. 17, 2018.
Extended European Search Report in European Application No. 17187151.0, dated Jan. 18, 2018.
Extended European Search Report in European Application No. 17187152.8, dated Jan. 18, 2018.
U.S. Appl. No. 29/637,985, filed Feb. 23, 2018.
U.S. Appl. No. 29/637,988, filed Feb. 23, 2018.
Office Action in Japanese Application No. 2017-176484, dated Oct. 17, 2018, including English translation (11 pages).
Office Action in Japanese Application No. 2017-176483, dated Oct. 17, 2018, including English translation (9 pages).
Annex to Office Action pursuant to Article 94(3) EPC of European Patent Application No. 17191762.8 dated Dec. 20, 2018 (6 pages).

* cited by examiner

METHOD OF OPERATING A CONNECTOR LATCH

CROSS-REFERENCE TO RELATED APPLICATIONS

This patent application claims priority to U.S. Provisional Patent Application No. 62/270,219, filed Dec. 21, 2015, which is hereby incorporated herein by reference in its entirety.

BACKGROUND OF THE INVENTION

The present invention generally relates to a method of operating a connector latch used to securely hold together a connector apparatus, wherein the connector apparatus has at least a first connector assembly and a second connector assembly which can be mated together, for example.

BRIEF SUMMARY OF THE INVENTION

After the connector latch of the present invention is manufactured, the connector latch is in an undeflected position. The connector latch is then subjected to a pre-mating deflection process, in order to deflect the connector latch and lock the connector latch in a preloaded position. After the pre-mating deflection process has been completed, the connector latch is locked in a preloaded position and can be referred to as a preloaded connector latch.

The preloaded connector latch provides a number of desirable characteristics, including at least, for example: an audible "click" sound when a first connector assembly and a second connector assembly are mated together, which is an extra loud sound; a low profile; a resistance to permanent set; and good dimensional control of latching geometry.

It is a desirable trait to have an audible "click" sound. For example, when components of an automotive connector are completely mated with each other, it is a desirable trait to have an audible "click" sound for convenient assurance that the components are completely mated. In the automotive connector field, an extra loud sound is favorable. It is desirable to have the loudest "click" sound possible. The "click" sound can be achieved by an interaction of latching features, for example. By placing latching features in a preloaded condition, there is additional force when a first connector assembly and a second connector assembly are mated together, and that additional force helps to make the "click" sound louder than it would have been if the latching features had not been in a preloaded condition.

It is a desirable trait to have a low profile. By manufacturing the connector latch in an undeflected position, the gaps required to create overstress protection features, to prevent the connector latch from being pried in the wrong direction and damaged, are not needed. The gaps can be removed from the overall height of the latch system, so that the connector latch can have a low profile.

It is a desirable trait to have a resistance to being permanently set. For example, when automotive wire harnesses are bundled for shipment, the connector latches can be unintentionally compressed and held in a deflected position. Especially in hot environments, this condition causes the connector latch to be permanently deflected, also known as permanently set, thus rendering the connector latch useless or less effective. Preloading the connector latch makes the connector latch more resistant to this failure mode.

It is a desirable trait to have good dimensional control of latching geometry. By preloading the connector latch against dimensionally stable features, the height of the connector latch features can be controlled easily.

When a first connector assembly and a second connector assembly are engaged together, the engagement thereof is assured because the connector latch causes an audible "click" sound. A first connector assembly can correspond to a female connector assembly or other type of connector assembly, for example. A second connector assembly can correspond to a male connector assembly or other type of connector assembly, for example. The undeflected position can also be referred to as an extended and relaxed undeflected position.

Additional features, advantages, and embodiments of the invention are set forth or are apparent from consideration of the following detailed description, drawings and claims. Moreover, it is to be understood that both the foregoing summary of the invention and the following detailed description are exemplary and are intended to provide further explanation without limiting the scope of the invention as claimed.

DETAILED DESCRIPTION OF THE PREFERRED EMBODIMENTS

Figure 1:
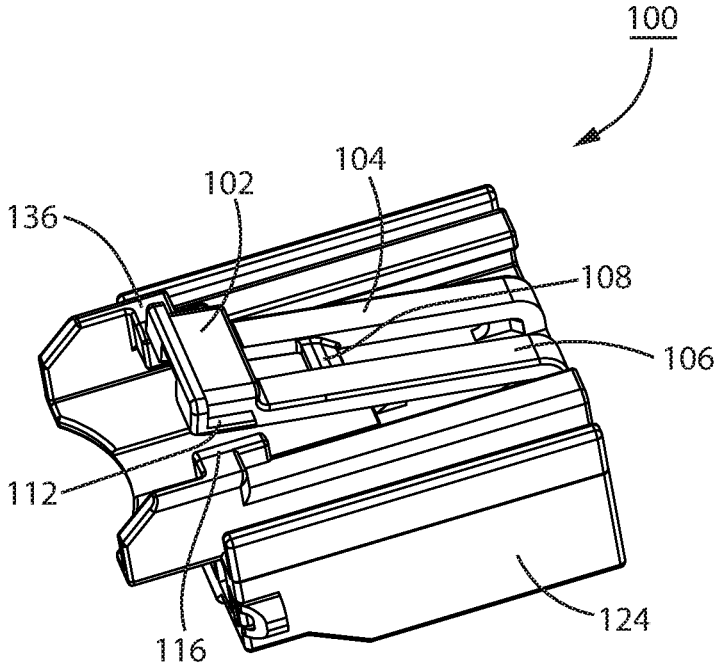
FIG. 1 is a first perspective view of a female connector assembly having a connector latch in accordance with the principles of the present invention, showing the connector latch in an undeflected position.

FIG. 1 is a first perspective view of a female connector assembly having a connector latch in accordance with the principles of the present invention, showing the connector latch in an undeflected position.

FIG. 1 illustrates a female connector assembly, generally referred to by reference numeral 100, which includes a connector latch having at least a button 102, a first latch beam 104, a second latch beam 106 and a latch surface 108. Reference numeral 136 denotes a top surface of the female connector assembly 100. FIG. 1 also shows a second overstress protection surface 112 on a side of the button 102, a second frame 116 of the female connector assembly 100, and a second side 124 of the female connector assembly 100.

The first latch beam 104 and second latch beam 106 are flexible, and permit the button 102 to move up and down without breaking. The resting position of the latch beams 104 and 106 is shown in FIG. 1, which is a position wherein the button 102 is extended upward above the top 136 of the female connector assembly 100, which corresponds to the position of the latch beams 104 and 106 when manufactured. When the button 102 is pushed down toward bottom 138, then the beams 104 and 106 bend down, without breaking, to permit the button 102 to be moved downward.

Figure 7:
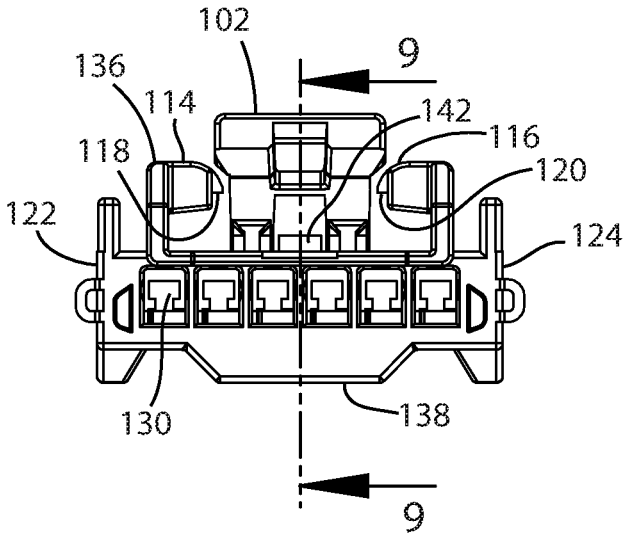
FIG. 7 is a front end elevational view of the female connector assembly shown in FIG. 1.
Figure 8:
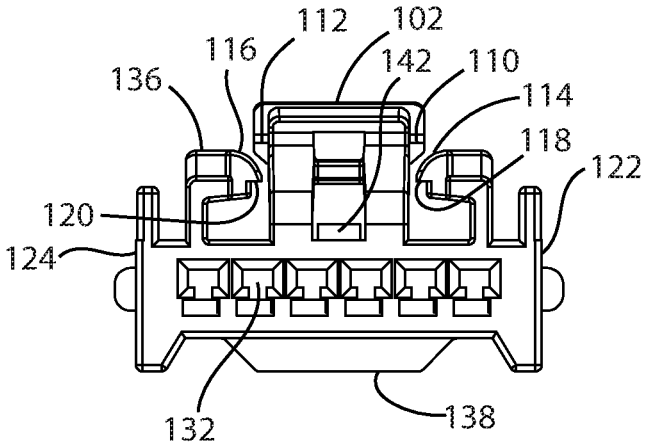
FIG. 8 is a rear end elevational view of the female connector assembly shown in FIG. 1.

If a user pushes the button 102, shown in FIG. 8, only slightly down toward bottom 138, while the user is careful to keep surface 112 above surface 120 and is careful to keep surface 110 above surface 118, then the button 102 will spring back upward to its resting position (shown in FIGS. 1-9) when the user releases the button 102. The button 102 springs back upward to its resting position because the user temporarily deflected the button 102 (and flexible latch beams 104, 106) downward, and then the user released the button 102 which enabled the button 102 and latch beams 104, 106 to rise up again to go back to their resting position.

Figure 2:
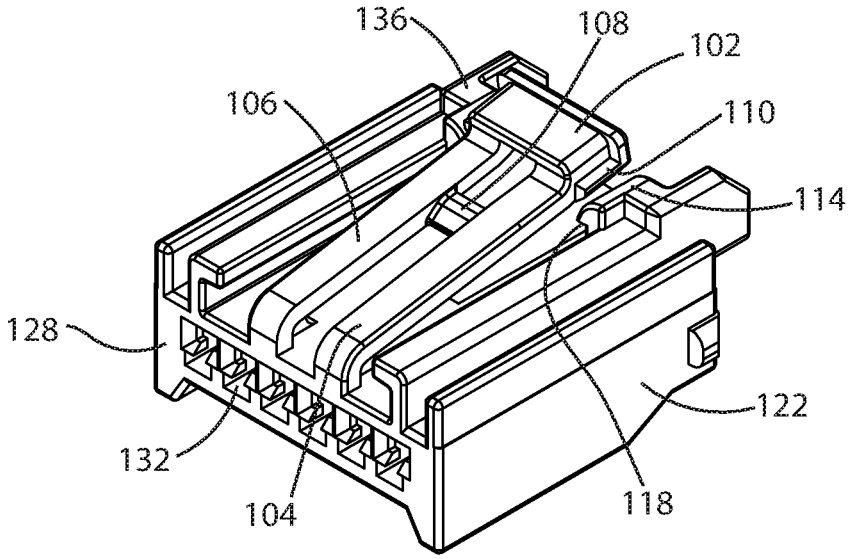
FIG. 2 is a second perspective view of the female connector assembly shown in FIG. 1.

FIG. 2 is a second perspective view of the female connector assembly shown in FIG. 1. FIG. 2 illustrates the female connector assembly 100 having at least a first overstress protection surface 110 on a side of the button 102, a first frame 114 of the female connector assembly 100, a first overstress protection surface 118 on the first frame 114 of the female connector assembly 100, a first side 122 of the female connector assembly 100, a rear 128 of the female connector assembly 100, and at least one terminal aperture 132 on the rear 128 of the female connector assembly 100.

Figure 3:
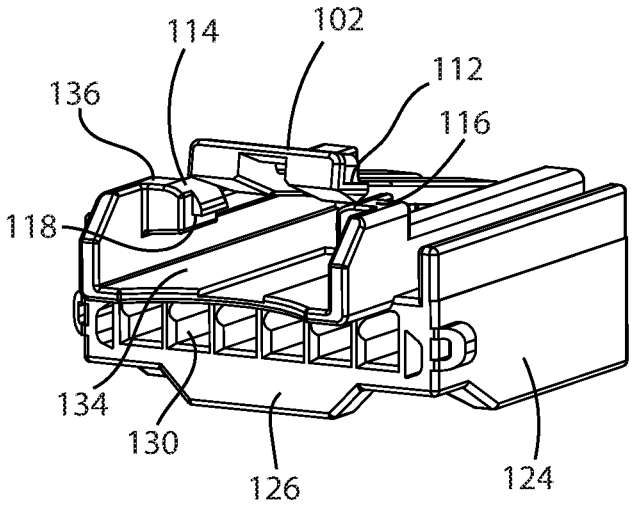
FIG. 3 is a third perspective view of the female connector assembly shown in FIG. 1.

FIG. 3 is a third perspective view of the female connector assembly shown in FIG. 1. FIG. 3 illustrates at least a front 126 of the female connector assembly 100, at least one terminal aperture 130 on the front 126 of the female connector assembly 100, and an aperture 134 for receiving an optional connector position assurance (CPA) unit on the front 126 of the female connector assembly 100.

Figure 4:
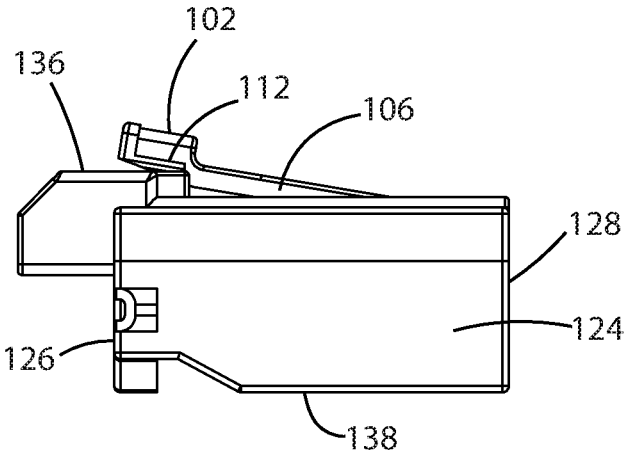
FIG. 4 is a side elevational view of the female connector assembly shown in FIG. 1.

FIG. 4 is a side elevational view of the female connector assembly shown in FIG. 1. Reference numeral 138 denotes a bottom of the female connector assembly 100.

Figure 5:
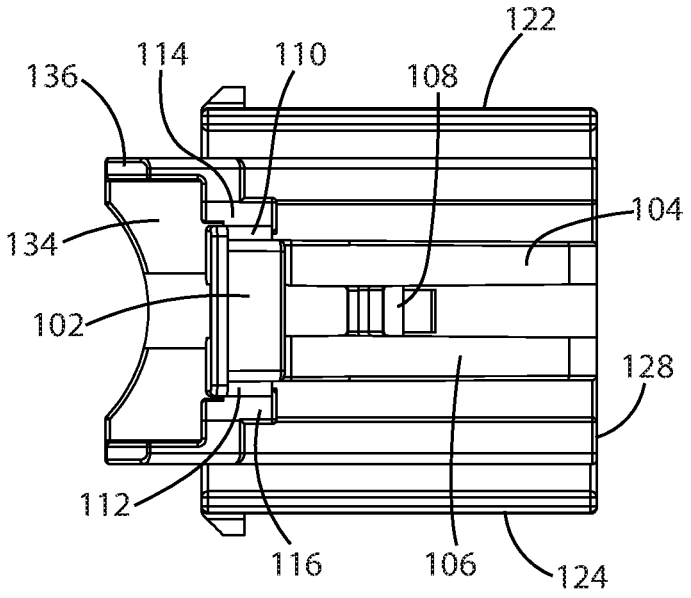
FIG. 5 is a top elevational view of the female connector assembly shown in FIG. 1.
Figure 6:
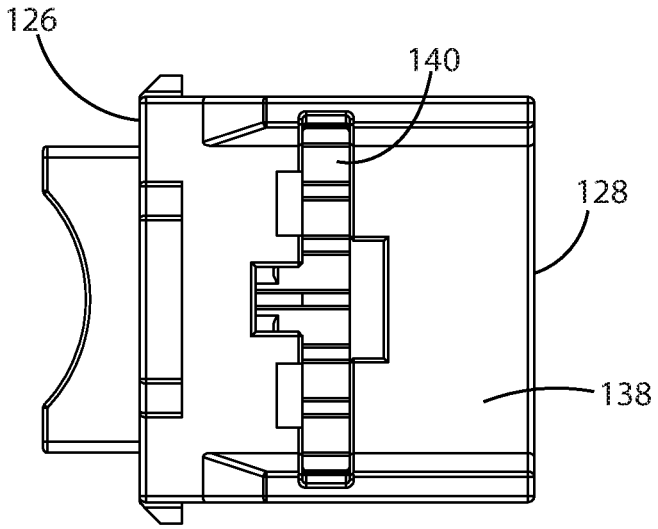
FIG. 6 is a bottom elevational view of the female connector assembly shown in FIG. 1.

FIG. 5 is a top elevational view of the female connector assembly shown in FIG. 1. FIG. 6 is a bottom elevational view of the female connector assembly shown in FIG. 1. Reference numeral 140 denotes an aperture for receiving an optional terminal position assurance (TPA) unit on the bottom 138 of the female connector assembly 100.

FIG. 7 is a front end elevational view of the female connector assembly shown in FIG. 1. Reference numeral 142 denotes a shark fin on the female connector assembly 100. Reference numeral 120 denotes a second overstress protection surface on the second frame 116 of the female connector assembly 100. Reference numeral 142 can also be referred to as a protrusion.

Figure 9:
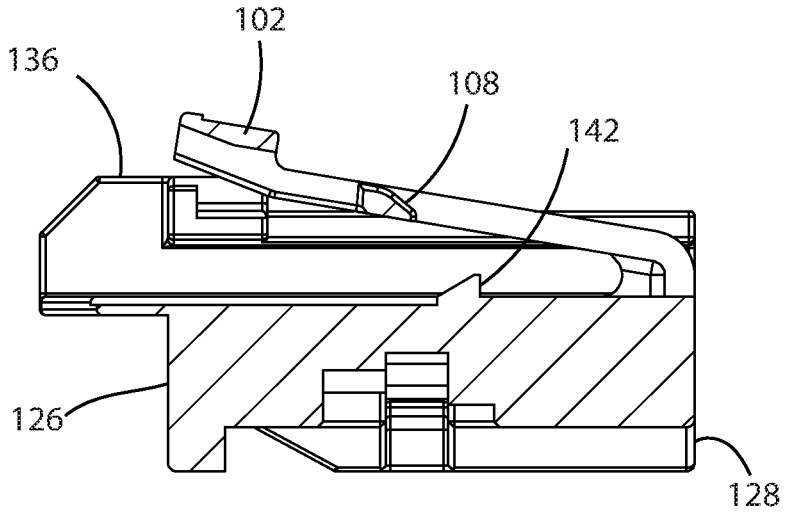
FIG. 9 is a cross-sectional view, taken along line 9-9 in FIG. 7, of the female connector assembly.

FIG. 8 is a rear end elevational view of the female connector assembly shown in FIG. 1. FIG. 9 is a cross-sectional view, taken along line 9-9 in FIG. 7, of the female connector assembly.

After the connector latch of the present invention is manufactured, the connector latch is in the extended and relaxed undeflected position. FIGS. 1-9 depict the female connector assembly 100 showing the connector latch in the extended and relaxed undeflected position. As shown in FIG. 1, the button 102 is extended upward, above a top surface 136 of the female connector assembly 100. FIG. 8 also shows that the button 102 is extended upward, above a top surface 136 of the female connector assembly 100. As shown in FIG. 1, for example, the button 102 is held up in the extended and relaxed undeflected position by the latch beams 104 and 106.

As indicated above, after the connector latch of the present invention is manufactured, the connector latch is in the extended and relaxed undeflected position. The connector latch is then subjected to a pre-mating deflection process, in order to deflect the connector latch and lock the connector latch in a preloaded position.

After the pre-mating deflection process has been completed, the connector latch is locked in a preloaded position and can be referred to as a preloaded connector latch.

Figure 10:
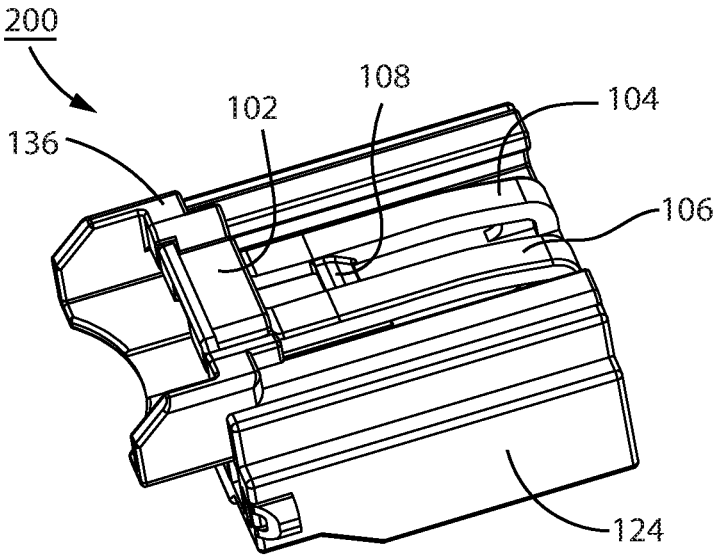
FIG. 10 is a first perspective view of a female connector assembly having a connector latch in accordance with the principles of the present invention, showing the connector latch in a preloaded position.

FIG. 10 is a first perspective view of a female connector assembly having a connector latch in accordance with the principles of the present invention, showing the connector latch in a preloaded position. Reference numeral 200 denotes a female connector assembly having a connector latch in a preloaded position.

Figure 11:
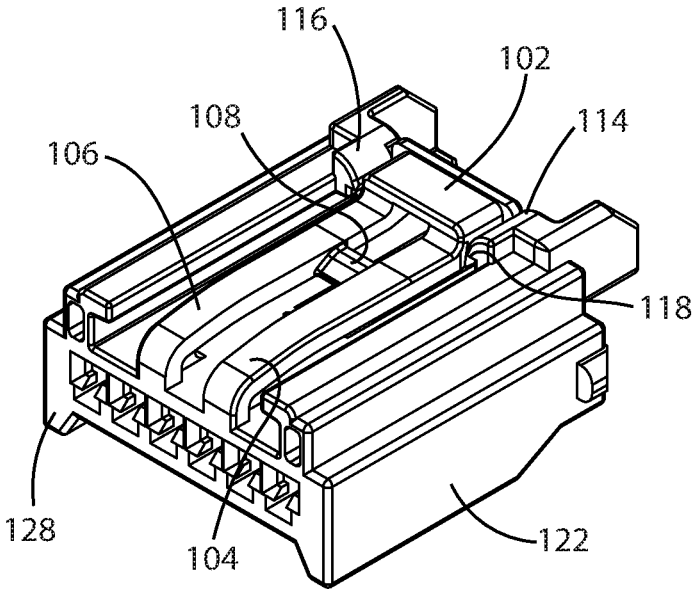
FIG. 11 is a second perspective view of the female connector assembly shown in FIG. 10.
Figure 12:
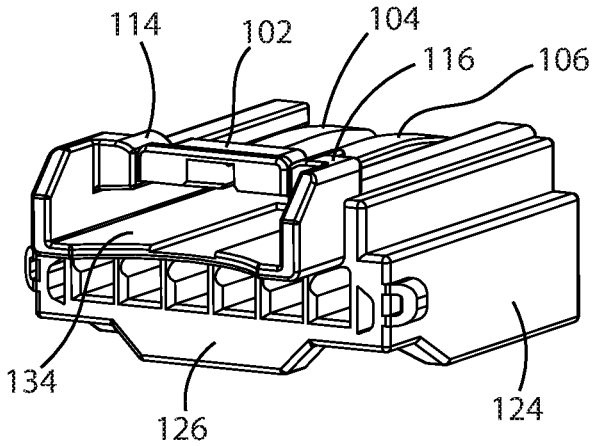
FIG. 12 is a third perspective view of the female connector assembly shown in FIG. 10.
Figure 13:
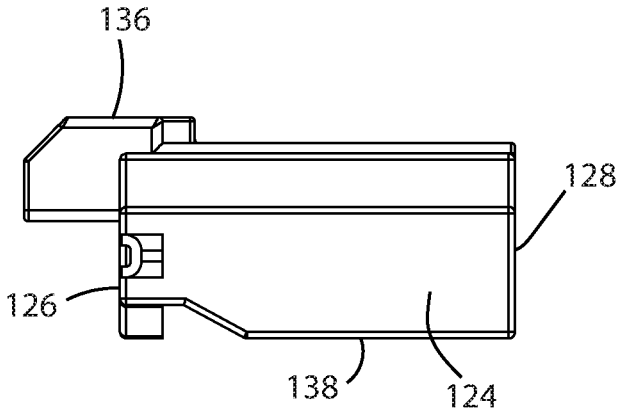
FIG. 13 is a side elevational view of the female connector assembly shown in FIG. 10.
Figure 14:
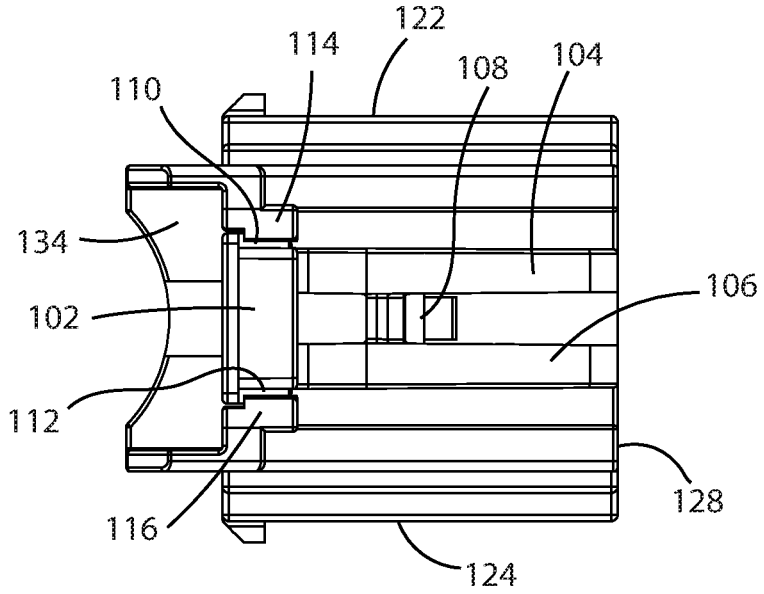
FIG. 14 is a top elevational view of the female connector assembly shown in FIG. 10.
Figure 15:
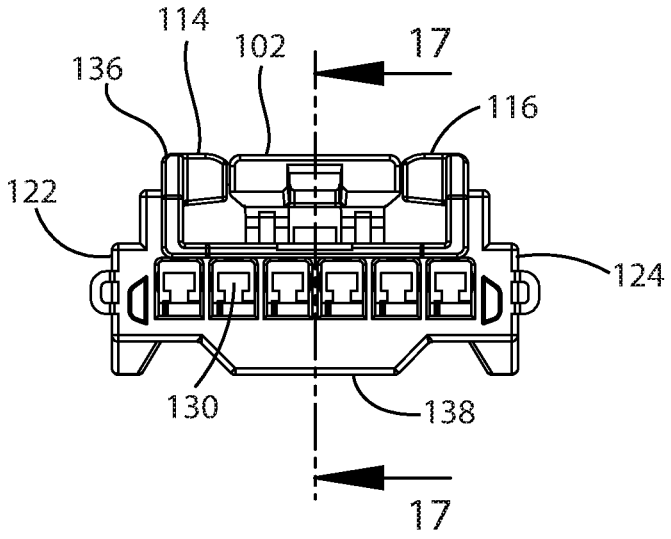
FIG. 15 is a front end elevational view of the female connector assembly shown in FIG. 10.
Figure 16:
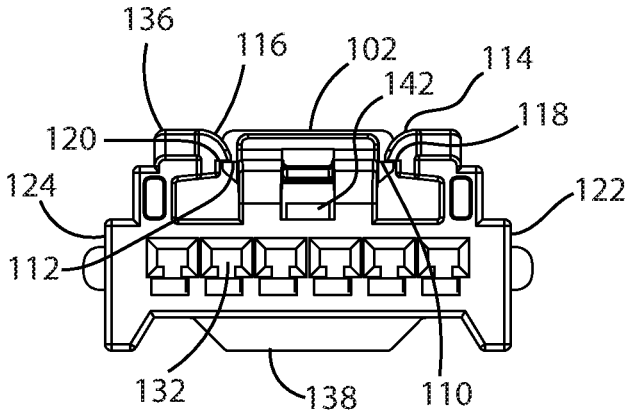
FIG. 16 is a rear end elevational view of the female connector assembly shown in FIG. 10.
Figure 17:
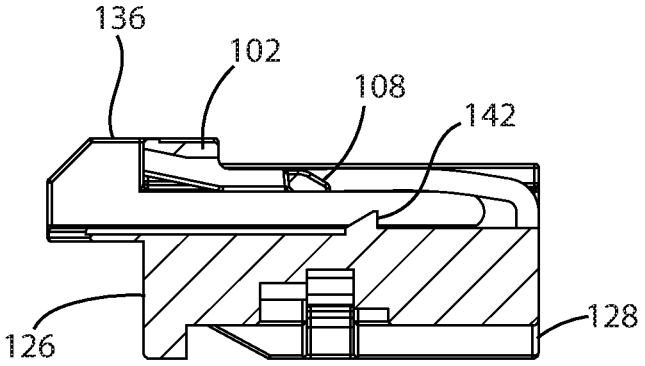
FIG. 17 is a cross-sectional view, taken along line 17-17 in FIG. 15, of the female connector assembly.

FIG. 11 is a second perspective view of the female connector assembly shown in FIG. 10. FIG. 12 is a third perspective view of the female connector assembly shown in FIG. 10. FIG. 13 is a side elevational view of the female connector assembly shown in FIG. 10. FIG. 14 is a top elevational view of the female connector assembly shown in FIG. 10. FIG. 15 is a front end elevational view of the female connector assembly shown in FIG. 10. FIG. 16 is a rear end elevational view of the female connector assembly shown in FIG. 10. FIG. 17 is a cross-sectional view, taken along line 17-17 in FIG. 15, of the female connector assembly.

FIGS. 10-17 show the connector latch in the preloaded position. As shown in FIGS. 10-17, when the connector latch is in the preloaded position, the button 102 is not extended upward above the top surface 136 of the female connector assembly 200.

A pre-mating deflection process is utilized to move the button 102 of the connector latch down from the undeflected position (shown in FIGS. 1-9) to the preloaded position (shown in FIGS. 10-17), and lock the connector latch in the preloaded position.

When a pre-mating deflection process is performed, the button 102 is moved downward toward the bottom surface 138 of the female connector assembly, and latch beams 104 and 106 are deflected.

When the connector latch is locked in the preloaded position, the first overstress protection surface 110 on the button 102 is engaged with the first overstress protection surface 118 on the first frame 114 of the female connector assembly, and the second overstress protection surface 112 on the button 102 is engaged with the second overstress protection surface 120 on the second frame 116 of the female connector assembly, as shown in FIG. 16.

Figure 18:
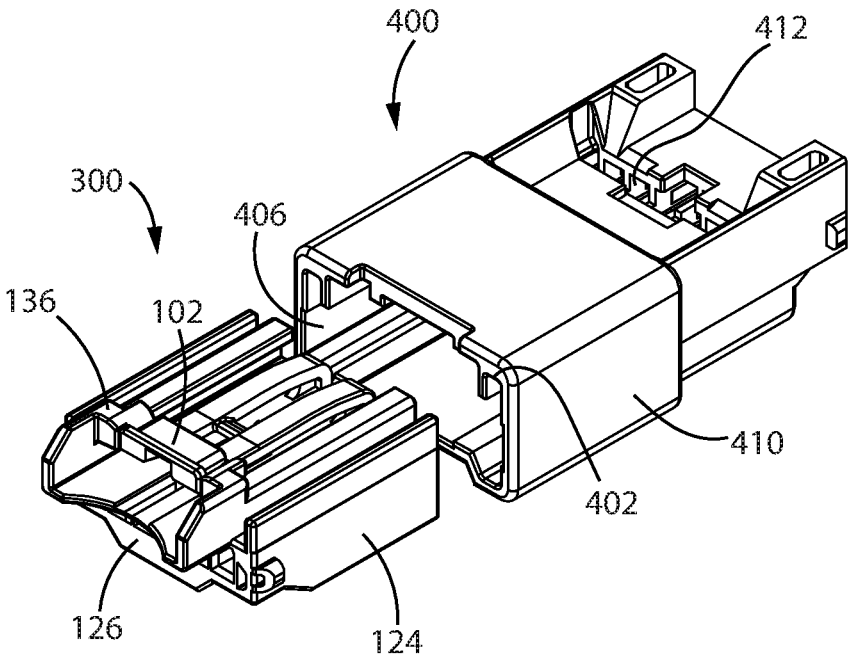
FIG. 18 is an exploded perspective view of a female connector assembly and a male connector assembly, depicting step one of a three-step mating process, wherein the female connector assembly has a connector latch in accordance with the principles of the present invention, showing the connector latch in a preloaded position.

FIG. 18 is an exploded perspective view of a female connector assembly and a male connector assembly, depicting step one of a three-step mating process, wherein the female connector assembly has a connector latch in accordance with the principles of the present invention, showing the connector latch in a preloaded position. FIG. 18 illustrates a connector apparatus, wherein the connector apparatus has at least a female connector assembly 300 and a male connector assembly 400 which can be mated together.

FIG. 18 depicts a front 402 of the male connector assembly 400, an aperture 406 for receiving rear of the female connector assembly 300, a second side 410 of the male connector assembly 400, and an aperture 412 for receiving an optional terminal position assurance (TPA) unit on the male connector assembly 400.

Figure 19:
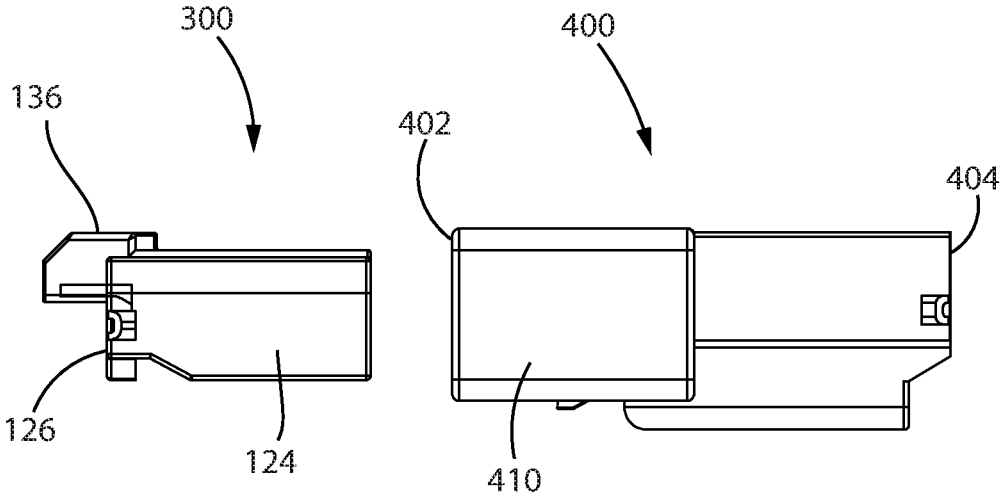
FIG. 19 is a side elevational view of the configuration shown in FIG. 18.
Figure 20:
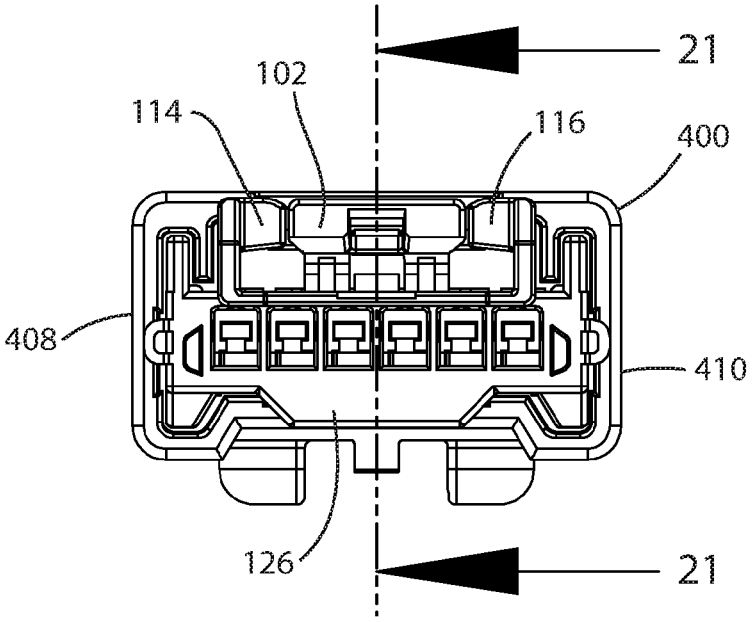
FIG. 20 is a front end elevational view of the configuration shown in FIG. 18.

FIG. 19 is a side elevational view of the configuration shown in FIG. 18. Reference numeral 404 denotes a rear of the male connector assembly 400. FIG. 20 is a front end elevational view of the configuration shown in FIG. 18. Reference numeral 408 denotes a first side of the male connector assembly 400.

Figure 21:
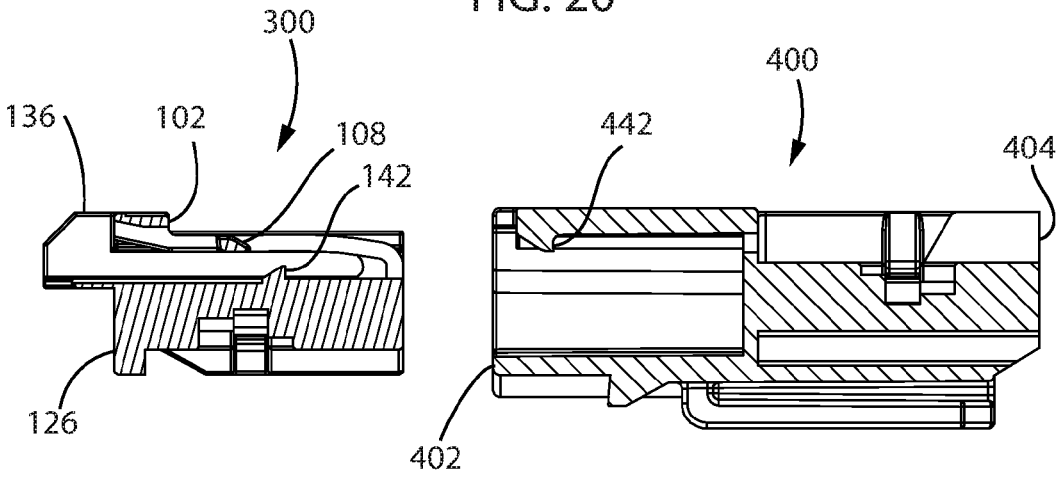
FIG. 21 is a cross-sectional view, taken along line 21-21 in FIG. 20.

FIG. 21 is a cross-sectional view, taken along line 21-21 in FIG. 20. Reference numeral 442 denotes a shark fin on the male connector assembly 400. Reference numeral 442 can also be referred to as a protrusion.

As shown in FIGS. 18-21, the shark fin 442 of the male connector assembly 400 has not yet engaged the latch surface 108 of the connector latch on the female connector assembly 300.

As shown in FIGS. 18-21, the connector latch of the female connector assembly 300 is in the undeflected position. The shark fin 442 has not yet contacted the latch surface 108 of the female connector assembly 300, as shown in FIG. 21. The button 102 is at or near the same level as the top surface 136 of the female connector assembly 300, as shown in FIG. 21.

Figure 22:
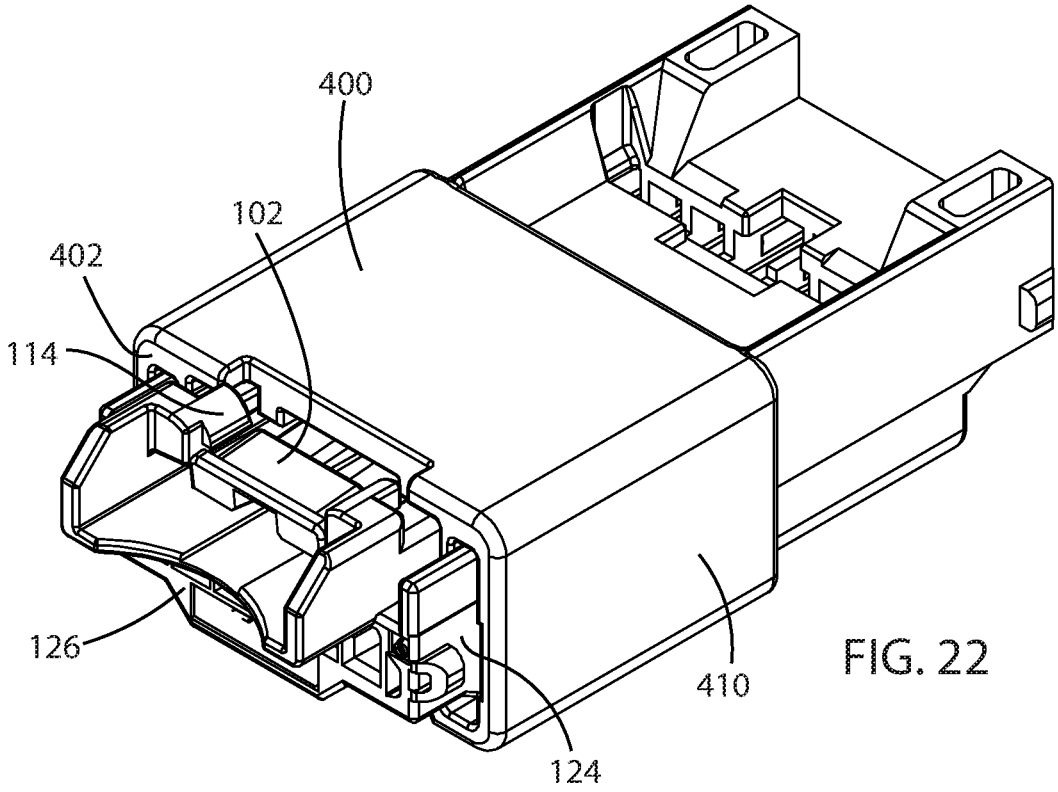
FIG. 22 is a perspective view of a female connector assembly and a male connector assembly, depicting step two of a three-step mating process, wherein the female connector assembly has a connector latch in accordance with the principles of the present invention.

FIG. 22 is a perspective view of a female connector assembly and a male connector assembly, depicting step two of a three-step mating process, wherein the female connector assembly has a connector latch in accordance with the principles of the present invention.

Figure 23:
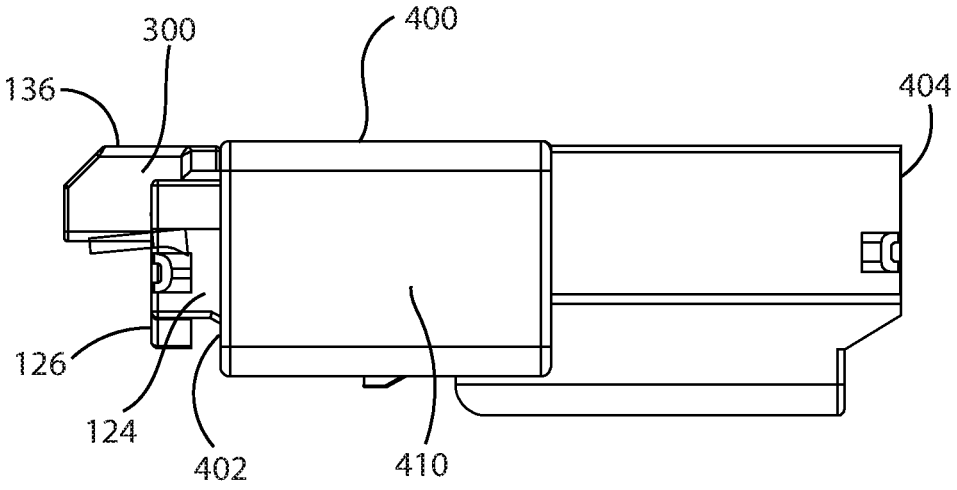
FIG. 23 is a side elevational view of the configuration shown in FIG. 22.
Figure 24:
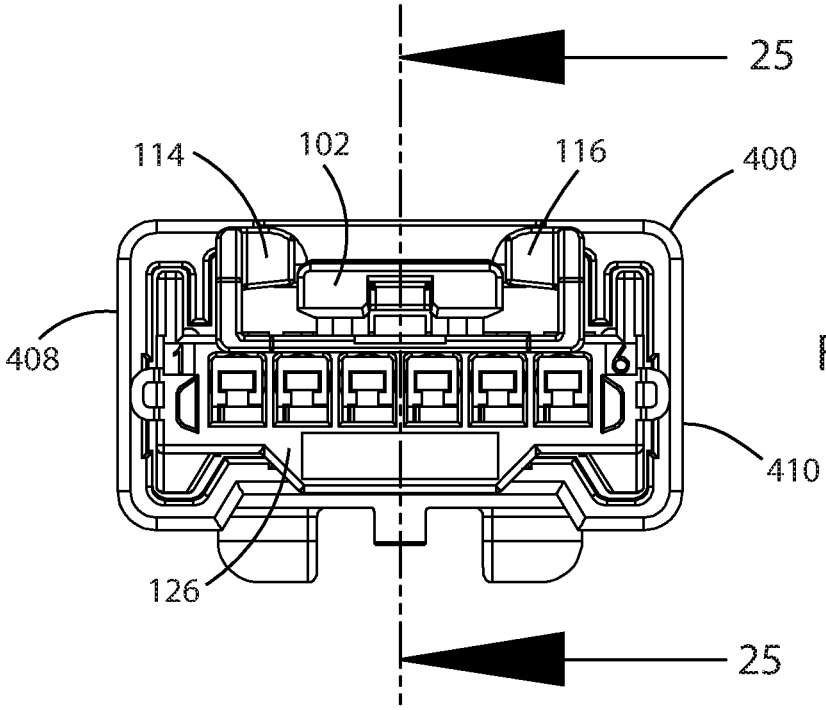
FIG. 24 is a front end elevational view of the configuration shown in FIG. 22.
Figure 25:
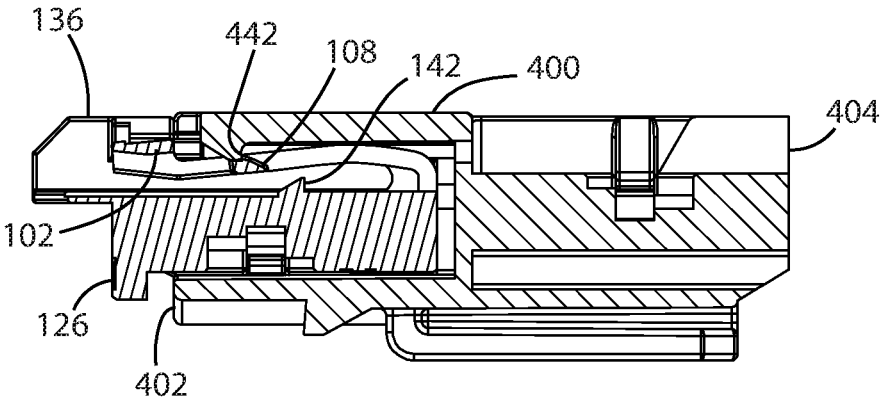
FIG. 25 is a cross-sectional view, taken along line 25-25 in FIG. 24.

FIG. 23 is a side elevational view of the configuration shown in FIG. 22. FIG. 24 is a front end elevational view of the configuration shown in FIG. 22. FIG. 25 is a cross-sectional view, taken along line 25-25 in FIG. 24.

As shown in FIGS. 22-25, the shark fin 442 of the male connector assembly 400 is engaging the latch surface 108 of the connector latch on the female connector assembly 300. Because the shark fin 442 of the male connector assembly 400 engages the latch surface 108 of the connector latch on the female connector assembly 300, as shown in FIGS. 22-25, in step two of the three-step mating process, the button 102 is moved downward toward the bottom surface 138 of the female connector assembly 300, and latch beams 104 and 106 are deflected.

As shown in FIGS. 22-25, the connector latch of the female connector assembly 300 is not in the undeflected position, and the connector latch of the female connector assembly 300 is not in the preloaded position. The connector latch of the female connector assembly 300 is in a transitional position. The shark fin 442 is now contacting the latch surface 108, and is now positioned above the latch surface 108 and is pushing the latch surface 108 downward toward the bottom of the female connector assembly 300.

FIG. 7 shows that a top of the button 102 is above the top surface 136 of a female connector assembly, when the connector latch is in the undeflected position. FIG. 16 shows that a top of the button 102 is at or near the same level as the top surface 136 of a female connector assembly (see also FIG. 20), when the connector latch is locked in the preloaded position. FIG. 24 shows that a top of the button 102 is below the top surface 136 of a female connector assembly, when the connector latch of the female connector assembly 300 is in a transitional position.

As shown in FIG. 24, a top of the button 102 is below the top surface 136 of a female connector assembly because shark fin 442 is engaging the latch surface 108. FIG. 25 shows that the shark fin 442 is engaging the latch surface 108.

Figure 26:
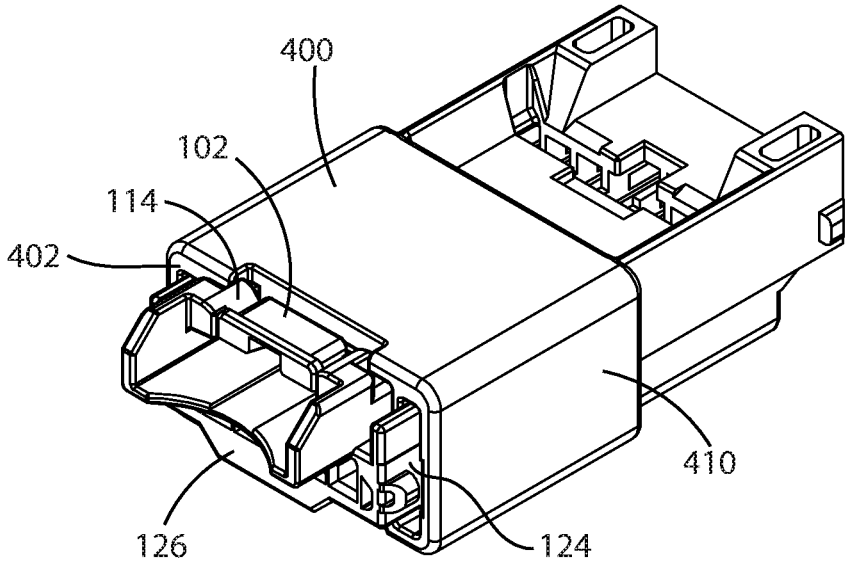
FIG. 26 is a perspective view of a female connector assembly and a male connector assembly, depicting step three of a three-step mating process, wherein the female connector assembly has a connector latch in accordance with the principles of the present invention.

FIG. 26 is a perspective view of a female connector assembly and a male connector assembly, depicting step three of a three-step mating process, wherein the female connector assembly has a connector latch in accordance with the principles of the present invention.

Figure 27:
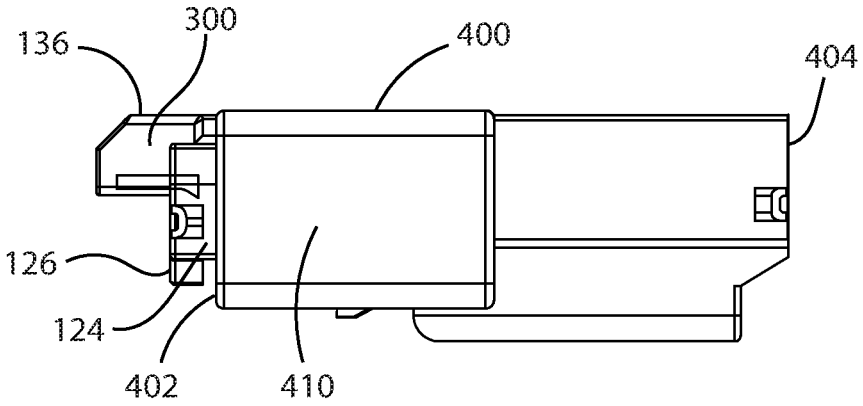
FIG. 27 is a side elevational view of the configuration shown in FIG. 26.
Figure 28:
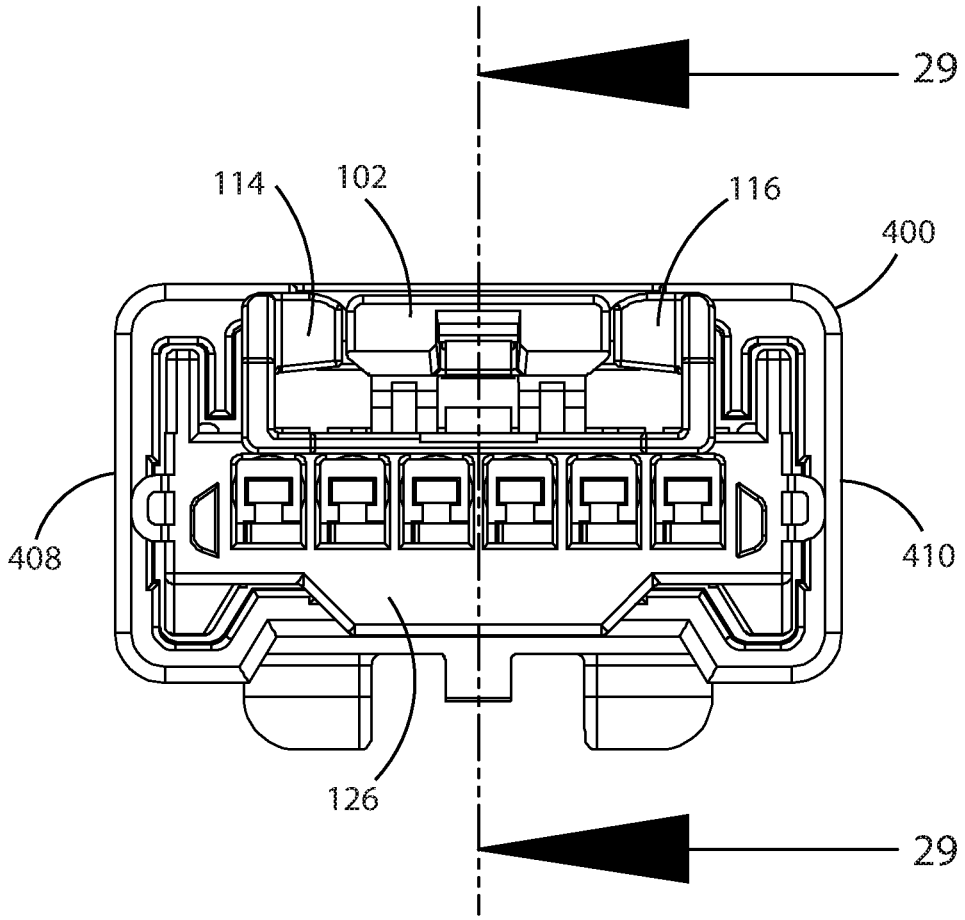
FIG. 28 is a front end elevational view of the configuration shown in FIG. 26.
Figure 29:
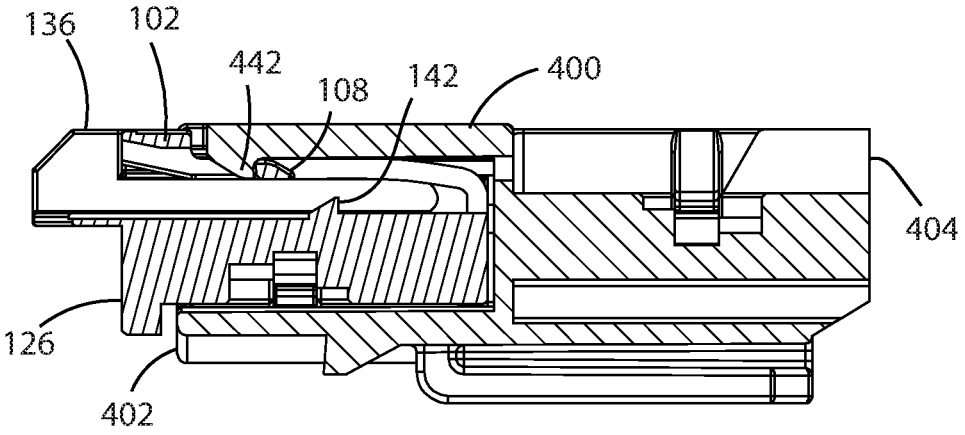
FIG. 29 is a cross-sectional view, taken along line 29-29 in FIG. 28.

FIG. 27 is a side elevational view of the configuration shown in FIG. 26. FIG. 28 is a front end elevational view of the configuration shown in FIG. 26. FIG. 29 is a cross-sectional view, taken along line 29-29 in FIG. 28.

As shown in FIGS. 26-29, the connector latch of the female connector assembly 300 is locked in the preloaded position. The shark fin 442 is now between the front 126 of the female connector assembly 300 and the latch surface 108 of the female connector assembly 300, as shown in FIG. 29. The button 102 is at or near the same level as the top surface 136 of the female connector assembly 300, as shown in FIG. 29. The position of the shark fin 442, in relation to the position of the latch surface 108, holds the female connector assembly 300 to the male connector assembly 400.

A locking aperture is formed by the following four components: the button 102; the first latch beam 104; the second latch beam 106; and the latch surface 108 (see FIG. 1). That is, the locking aperture is an orifice that has four sides, such that one side corresponds to a part of the button 102, one side corresponds to a part of the first latch beam 104, one side corresponds to the second latch beam 106, and one side corresponds to the latch surface 108 (see FIG. 1). The shark fin 442 is shown to be occupying at least a portion of that locking aperture in FIG. 29. As shown in FIG. 29, the shark fin 442 is held in the locking aperture, and this helps to hold the female connector assembly 300 and the male connector assembly 400 properly and fully mated together.

When the button 102, first latch beam 104, and second latch beam 106 move from the transitional position (FIGS. 22-25) to a subsequent preloaded position (FIGS. 26-29), there is an extra loud "click" sound caused by multiple surfaces hitting each other which can include, for example, one or more of the following: (1) the surface 110 hitting the surface 118; (2) the surface 112 hitting the surface 120; and (3) upper surfaces of latch beams 104, 106 hitting interior surfaces of the male connector assembly 400.

The extra loud "click" sound, which occurs when the button 102, first latch beam 104, and second latch beam 106 move from the transitional position (FIGS. 22-25) to a subsequent preloaded position (FIGS. 26-29), provides a convenient assurance that the female connector assembly 300 and the male connector assembly 400 are properly and completely mated together.

According to the principles disclosed herein, a "click" sound is extra loud, when a female connector assembly is completely and properly mated with a male connector assembly, for multiple reasons which can include at least the following reasons, for example: (A) first, the connector latch on a female connector assembly was manufactured to be in an extended and relaxed undeflected position (this position is shown in FIG. 4, wherein the button 102 extends upward away from the bottom 138, for example); (B) second, after manufacturing, the connector latch on the female connector assembly was subjected to a pre-mating process to deflect the button 102 downward in a direction toward the bottom 138, thus moving the connector latch to a preloaded position prior to the mating of the female connector assembly with a male connector assembly; (C) third, all of the surfaces contacting each other as a result of performing step three of the above-discussed three-step mating process come together with significant force resulting in an extra loud "click" sound; and (4) the female connector assembly and the male connector assembly are mated together with force.

Figure 30:
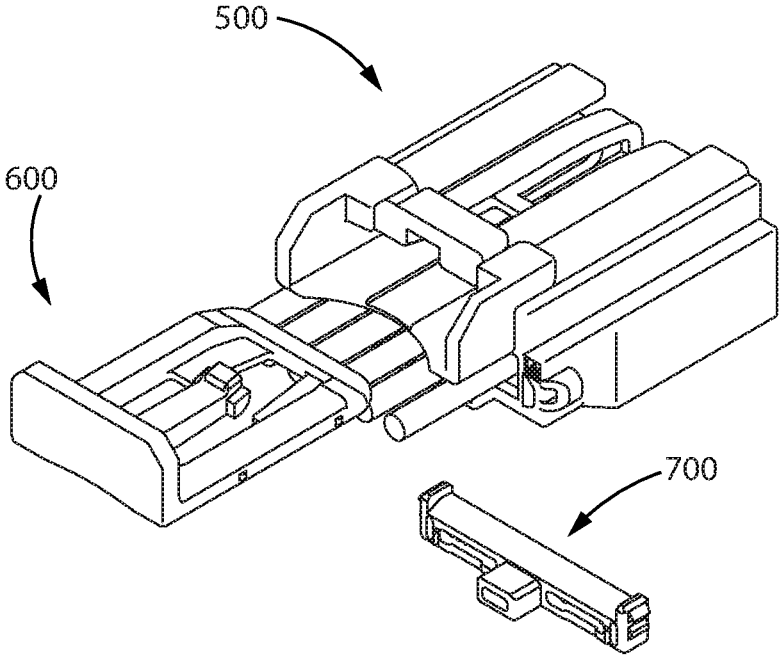
FIG. 30 is an exploded perspective view of a female connector assembly, a connector position assurance (CPA) unit, and a terminal position assurance (TPA) unit, wherein the female connector assembly has a connector latch in accordance with the principles of the present invention.

FIG. 30 is an exploded perspective view of a female connector assembly, a connector position assurance (CPA) unit, and a terminal position assurance (TPA) unit, wherein the female connector assembly has a connector latch in accordance with the principles of the present invention. FIG. 30 depicts a female connector assembly 500, an optional connector position assurance (CPA) unit 600, and an optional terminal position assurance (TPA) unit 700. The TPA can fit into the aperture 134 of the female connector assembly (see FIG. 12, for example). The TPA 700 can fit into the aperture 140 on the bottom of the female connector assembly (see FIG. 6, for example). The CPA unit 600 can engage with the shark fin 142 on a female connector assembly.

The first latch beam 104 has a first end which has a curved portion in a region where the first latch beam 104 meets a body portion of the female connector assembly 100, just above the terminal apertures 132, as shown in FIG. 2. The first latch beam 104 has a distal end where the first latch beam 104 meets the button 102.

The second latch beam 106 has a first end which has a curved portion in a region where the second latch beam 106 meets a body portion of the female connector assembly 100, just above the terminal apertures 132, as shown in FIG. 2. The second latch beam 106 has a distal end where the second first latch beam 106 meets the button 102. The button 102 is at a distal end of the first latch beam 104 and a distal end of the second latch beam 106, as shown in FIG. 1.

If material utilized is sufficiently stiff, a connector latch can be formed without the second latch beam 106, consistent with the principles of the present invention, and will still be functional. When there is no second latch beam 106, the latch surface 108 will extend outward from a side of the first latch beam 104, and the button 102 will be at the distal end of the first latch beam 104. In this embodiment, an aperture is formed by the area between the button 102, first latch beam 104, and the latch surface 108. The shark fin 442 will be located in that aperture when a female connector assembly is properly and fully mated with a male connector assembly, in accordance with the principles disclosed herein.

A first connector assembly having a connector latch of the present invention can be represented by the female connector assembly 100, the female connector assembly 200, the female connector assembly 300, the female connector assembly 500, or other connector assembly, for example. A second connector assembly can be represented by the male connector assembly 400, or other connector assembly, for example. The connector latch, the first connector assembly, the second connector assembly, the CPA unit, and/or the TPA unit can be made from one or more plastic materials and/or other materials.

It can be said that a first connector assembly has a connector latch, and that connector latch includes at least the button 102, the first latch beam 104, the second latch beam 106, the latch surface 108, and other features, for example.

Alternatively, it can be said that a connector latch comprises features including at least a first connector assembly (for example, the female connector assembly 100), the button 102, the first latch beam 104, the second latch beam 106, the latch surface 108, the first overstress protection surface 110 on the button 102, the first overstress protection surface 118 on the first frame 114 of the first connector assembly, the second overstress protection surface 112 on the button 102, the second overstress protection surface 120 on the second frame 116 of the first connector assembly.

The second overstress protection surface 112 on a side of the button 102, as shown in FIG. 1, extends outward away from the button 102 toward the general direction of the second frame 116. The top of surface 112 (depicted in FIG. 1 and indicated by reference numeral 112 in FIG. 1), and the bottom of surface 120 (depicted in FIG. 7 and indicated by reference numeral 120 in FIG. 7), are shown to be flat surfaces in the drawings, but other types of surfaces may be contemplated, consistent with the principles disclosed herein, so that an audible "click" sound results when the surfaces 112 and 120 hit each other, after the shark fin 442 pushes the latch surface 108 down (as shown in FIG. 25) and subsequently lets the latch surface 108 go up again (as shown in FIG. 29).

The first overstress protection surface 110 on a side of the button 102, as shown in FIG. 2, extends outward away from the button 102 toward the general direction of the first frame 114. The top side of surface 110 (visible in FIG. 2 and indicated by reference numeral 110 in FIG. 2), and the bottom side of surface 118 (depicted in FIG. 7 and indicated by reference numeral 118 in FIG. 7) are shown to be flat surfaces in the drawings, but other types of surfaces may be contemplated, consistent with the principles disclosed herein, so that an audible "click" sound results when the surfaces 110 and 118 hit each other, after the shark fin 442 pushes the latch surface 108 down (as shown in FIG. 25) and subsequently lets the latch surface 108 go up again (as shown in FIG. 29).

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Female connector assembly, with connector latch in an undeflected position
102 Button of connector latch
104 First latch beam of connector latch
106 Second latch beam of connector latch
108 Latch surface of connector latch
110 First overstress protection surface on side of button
112 Second overstress protection surface on side of button
114 First frame of female connector assembly
116 Second frame of female connector assembly
118 First overstress protection surface on first frame of female connector assembly
120 Second overstress protection surface on second frame of female connector assembly
122 First side of female connector assembly
124 Second side of female connector assembly
126 Front of female connector assembly
128 Rear of female connector assembly
130 Terminal aperture on front of female connector assembly
132 Terminal aperture on rear of female connector assembly
134 Aperture for receiving optional connector position assurance (CPA) unit, on front of female connector assembly
136 Top of female connector assembly
138 Bottom of female connector assembly
140 Aperture for receiving optional terminal position assurance (TPA) unit, on bottom of female connector assembly
142 Shark fin on female connector assembly
200 Female connector assembly, with connector latch in a preloaded position
300 Female connector assembly, with connector latch in a preloaded position
400 Male connector assembly
402 Front of male connector assembly
404 Rear of male connector assembly
406 Aperture for receiving rear of female connector assembly
408 First side of male connector assembly
410 Second side of male connector assembly
412 Aperture for receiving optional terminal position assurance (TPA) unit, on top of male connector assembly
442 Shark fin on male connector assembly
500 Female connector assembly, with connector latch in a preloaded position
600 Connector position assurance (CPA) unit
700 Terminal position assurance (TPA) unit

I claim:

1. A method of operating a connector latch, comprising:
moving a button of said connector latch from a first position to a second position, wherein
said button is located on a first connector assembly and has at least a first surface,
said first connector assembly has at least a first surface,
said first position corresponds to said first surface of said button not engaging with said first surface of said first connector assembly,
said second position corresponds to said first surface of said button engaging with said first surface of said first connector assembly, and
said first surface of said button is above said first surface of said first connector assembly when said button is in said first position, and
said first surface of said button is below said first surface of said first connector assembly when said button is in said second position.

2. The method of claim 1, wherein said first position corresponds to said connector latch being in an undeflected position, and said second position corresponds to said connector latch being in a preloaded position.

3. The method of claim 1, wherein said first connector assembly has a first frame, and said first surface of said first connector assembly is on said first frame.

4. The method of claim 1, wherein said button is on a latch beam, and said latch beam is made of plastic.

5. The method of claim 4, wherein said moving of said button from said first position to said second position is performed by pushing said button and thereby causing said latch beam to flex.

6. The method of claim 1, wherein said moving of said button corresponds to pushing said button toward said first surface of said first connector assembly to cause said first surface of said button to move beyond said first surface of said first connector assembly, and then releasing said button.

7. The method of claim 1, further comprising:
mating said first connector assembly with a second connector assembly, after said button has been moved from said first position to said second position, wherein
said connector latch emits an audible sound when said mating is performed between said first connector assembly and said second connector assembly.

8. The method of claim 7, wherein
said first connector assembly has a latch surface on said latch beam,
said second connector assembly has a protrusion,
said mating between said first connector assembly and said second connector assembly includes causing said protrusion to engage with and then disengage from said latch surface,
said connector latch emits said audible sound when said protrusion disengages from said latch surface while said mating is performed between said first connector assembly and said second connector assembly.

9. A method of operating a connector latch, comprising:
moving a button of said connector latch from a first position to a second position, wherein
said button is located at a distal end of a first latch beam and a second latch beam, and said button has at least a first surface and a second surface,
said first and second latch beams are connected to a body of a first connector assembly,
a latch surface connects said first and second latch beams,
said first connector assembly has at least a first surface and a second surface, said first position corresponds to said first surface of said button not engaging with said first surface of said first connector assembly and said second surface of said button not engaging with said second surface of said first connector assembly, said second position corresponds to said first surface of said button engaging with said first surface of said first connector assembly and said second surface of said button engaging with said second surface of said first connector assembly, said first surface of said button is on a side of said button and faces in a first direction outward away from said first connector assembly when said button is in said first position, and said first surface of said first connector assembly faces in a second direction opposite to the first direction when said button is in said second position.

10. The method of claim 9, wherein said first position corresponds to said connector latch being in an undeflected position, and said second position corresponds to said connector latch being in a preloaded position.

11. The method of claim 9, wherein said first connector assembly has a first frame, said first surface of said first connector assembly is on said first frame, said second connector assembly has a second frame, and said second surface of said first connector assembly is on said second frame.

12. The method of claim 9, wherein said button, said first latch beam, said second latch beam, and said latch surface form an aperture.

13. The method of claim 9, wherein said moving of said button from said first position to said second position is performed by pushing said button and thereby causing said latch beam to flex.

14. The method of claim 9, wherein said first connector assembly is made of plastic.

15. The method of claim 9, further comprising:

mating said first connector assembly with a second connector assembly, after said button has been moved from said first position to said second position, wherein said connector latch emits an audible sound when said mating is performed between said first connector assembly and said second connector assembly.

16. A method of operating a connector latch, comprising:

moving a button of said connector latch from a first position to a second position, wherein said button is connected to a first latch beam, and said button has at least a first surface and a second surface, said first latch beam is connected to a body of a first connector assembly, said first connector assembly has at least a first surface and a second surface, said first position corresponds to said first surface of said button not engaging with said first surface of said first connector assembly and said second surface of said button not engaging with said second surface of said first connector assembly, said second position corresponds to said first surface of said button engaging with said first surface of said first connector assembly and said second surface of said button engaging with said second surface of said first connector assembly, said first surface of said button is on a side of said button, faces in a first direction outward away from said first connector assembly, and is at a first side of said first surface of said first connector assembly when said button is in said first position, and said first surface of said first connector assembly faces in a second direction opposite to the first direction, and said first surface of said button is at a second side of said first surface of said first connector assembly, when said button is in said second position.

17. The method of claim 16, further comprising:

mating said first connector assembly with a second connector assembly, after said button has been moved from said first position to said second position, such that said connector latch emits an audible sound when said mating is performed between said first connector assembly and said second connector assembly, wherein said button is connected to a second latch beam, said second latch beam is connected to said body of said first connector assembly, a latch surface is disposed between said first and second latch beams, said second connector assembly has a protrusion, said mating between said first connector assembly and said second connector assembly includes causing said protrusion to engage with and then disengage from said latch surface, said connector latch emits said audible sound when said protrusion disengages from said latch surface while said mating is performed between said first connector assembly and said second connector assembly.

18. The method of claim 17, wherein said protrusion is at least partially in said aperture after said mating is performed between said first connector assembly and said second connector assembly.

19. The method of claim 18, wherein said protrusion has a shark fin shape.

20. The method of claim 17, wherein said first connector assembly forms a plurality of terminal apertures at a front thereof and at a rear thereof.

21. The method of claim 1, wherein said first surface of said button is at a first side of said first surface of said first connector assembly when said button is in said first position, and said first surface of said button is at a second side of said first surface of said first connector assembly when said button is in said second position.

22. The method of claim 21, wherein said first side is opposite to said second side.

23. The method of claim 1, wherein said first surface of said button is below said first surface of said first connector assembly when said button is in said second position.

24. The method of claim 3, wherein said first frame has a curved surface, and said button engages with said curved surface when said first button is moved from said first position to said second position.

* * * * *